United States Patent [19]

Imanaka

[11] Patent Number: 4,560,032

[45] Date of Patent: Dec. 24, 1985

[54] RESTAURANT FOOD DISPLAY AND SERVING SYSTEM

[76] Inventor: Shoichi Imanaka, 1737 Post St., Japan Center, San Francisco, Calif. 94115

[21] Appl. No.: 705,408

[22] Filed: Feb. 25, 1985

Related U.S. Application Data

[63] Continuation of Ser. No. 482,900, Apr. 7, 1983, abandoned.

[51] Int. Cl.[4] ..... E04H 3/04

[52] U.S. Cl. ..... 186/38; 104/73; 406/106

[58] Field of Search ..... 186/38, 49, 26; 198/811; 406/38, 40, 106, 77, 184; 104/70, 73; 272/32

[56] References Cited

U.S. PATENT DOCUMENTS

| | | | |
|---|---|---|---|
| 1,331,270 | 2/1920 | Lippincott | 272/32 |
| 1,388,975 | 8/1921 | Spink et al. | 186/38 |
| 1,389,611 | 9/1921 | Wood et al. | 272/32 |
| 1,411,432 | 8/1922 | Henderson | 186/49 |
| 1,607,771 | 11/1926 | Miller | 104/70 |
| 2,037,815 | 4/1936 | Ora | 186/49 |
| 2,666,519 | 1/1954 | Boots | 198/181 |
| 3,106,394 | 10/1963 | Gelbart | 272/8 |
| 3,263,776 | 8/1966 | Kroemer, Jr. | 186/49 |
| 3,378,105 | 4/1968 | Kroemer, Jr. | 186/49 |
| 3,901,355 | 8/1975 | Shiraishi | 186/49 |
| 4,165,075 | 8/1979 | Pipovich | 273/140 |
| 4,349,086 | 9/1982 | Yamada | 186/49 |
| 4,392,434 | 7/1983 | Darwald et al. | 272/32 |

FOREIGN PATENT DOCUMENTS

| | | | |
|---|---|---|---|
| 353571 | 4/1905 | France | 104/73 |

*Primary Examiner*—Joseph J. Rolla
*Assistant Examiner*—Kenneth Noland
*Attorney, Agent, or Firm*—Flehr, Hohbach, Test, Albritton & Herbert

[57] ABSTRACT

A restaurant food display and serving system including a food preparation area surrounded by a watercourse upon which a plurality of interconnected boats carrying a variety of foods on trays travel with a current.

13 Claims, 7 Drawing Figures

RESTAURANT FOOD DISPLAY AND SERVING SYSTEM

This is a continuation of application Ser. No. 482,900, filed Apr. 7, 1983, now abandoned.

BACKGROUND OF THE INVENTION

This invention relates to an attractive and nearly silent method of carrying and continuously displaying selected foods prepared in a food preparation area to the restaurant patron seated at a counter area surrounding the food preparation area.

Early efforts to introduce food conveyance into restaurants were primarily functional in nature, and probably not very attractive. Examples are (1) the Spink automotive restaurant U.S. Pat. No. 1,388,975 (1921) in which trays of food traveled by gravity on an inclined raceway from the kitchen to the patron on an upper deck and dirty dishes traveled on an oppositely inclined raceway back to the kitchen; all in full view of the patron. (2) The Henderson mechanical conveyor U.S. Pat. No. 1,411,432 (1922) in which the dishes traveled on an endless conveyor chain. (3) The Ora serving counter U.S. Pat. No. 2,037,815 (1936) another mechanical conveyor. (4) The Boots serving conveyor U.S. Pat. No. 2,666,519 (1954) still another mechanical conveyor; and (5) The Kroemer food service system, U.S. Pat. No. 3,263,776 (1966) and U.S. Pat. No. 3,378,105, a covered mechanical conveyor and telephone system.

The circulating food tables of Shiraishi, U.S. Pat. No. 3,901,355 (1975) and Yamada, U.S. Pat. No. 4,349,086 (1982) represents a new concept in the restaurant industry. Instead of conveying individual orders of selected foods to and from the food preparation area as previous automatic systems, a variety of foods are displayed on a mechanical conveyor system and the patron simply watches the conveyor until a food that suits his fancy passes in front of him. The dish is lifted from the constantly moving conveyor. Spilled food is generally not a serious problem provided an employee can stop the conveyor quickly. There is no provision for loading the dirty dishes back on the conveyor which is a distinct advantage over most of the prior art devices which subjected the patrons to some unpleasantry in seeing the remains of other patron's dinners.

In any event, in spite of the improvement in the systems, the recent circulating food tablets are still reliant on the standard mechanical conveyor system. While the foods on such mechanical tables may be attractively prepared and the counter and other decorations may be quite pleasant, one cannot escape the feeling of sitting on a factory assembly line or waiting in a crowded airport for his bag to come by on the baggage carrousel.

In at least one installation of a food bar in Japan, the system is similar to the fishing game device taught by Popovich, U.S. Pat. No. 4,165,075 (1979) in which the food dishes are placed on free floating discs which are not connected together. It has been found that after only a short time of operation, the floating discs become damaged by the constant collisions between the discs. Jamming at corners is also a problem.

SUMMARY OF THE INVENTION

The restaurant display and serving system of the present invention carries a variety of attractively prepared foods on individual serving trays on the decks of an endless string of small floating boats carried almost silently around a watercourse by a gentle water current.

The boats are large enough and sufficiently stable and travel at such a gentle rate that patrons may easily select and remove the dish of their choice.

Generally, the patrons do not stop the boats, but the entire system will stop and automatically start again if the patron does want additional time to make his selection.

The boats are connected at both the bow and stern to boats preceeding and following. The length of the line between the boats is selected so that the boats do not touch one another, thus eliminating damage to the boats, jamming of the boats at the bends in the watercourse or bumping the tasty cargo off the deck.

The display and serving system of boats on a watercourse is an attractive addition to the restaurant instead of an unpleasant mechanical distraction.

The individual boats move quietly around the watercourse and the rare food spill does not prevent the system from its continued operation or present a meticulous cleaning problem as in the previous mechanical conveyor systems.

The water in the watercourse can be slightly chilled or warmed to maintain the desired food temperature.

The individual boats are easily removed and replaced in the system for maintenance and cleaning and the water in the watercourse may be drained and replaced at necessary intervals.

DESCRIPTION OF THE PREFERRED EMBODIMENT

Figure 1:
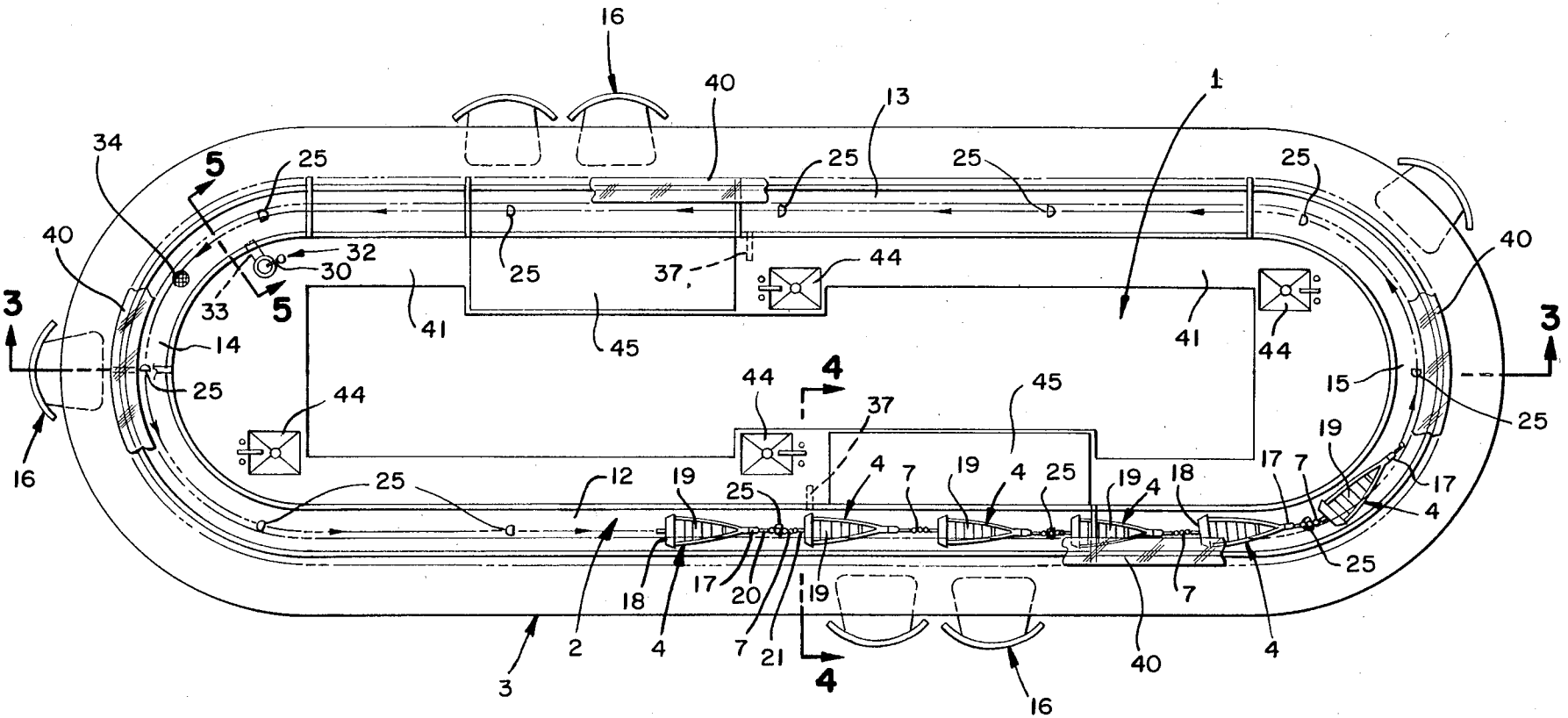
FIG. 1 is a plan view of the display and serving bar of the present invention.

The restaurant food display and serving system of the present invention consists briefly of a food preparation area 1, a watercourse 2 surrounding the food preparation area, a counter 3 for the receipt of food dishes surrounding the watercourse, a plurality of individual floating carriers 4 for transporting food 5 in receptacles 6, connecting means 7 joining the floating carriers in an endless succession spaced from one another a selected distance so that the individual carriers do not touch an adjacent carrier, and means for creating a water current in the watercourse for propelling the carrier around the watercourse.

The food preparation area 1 should be sufficiently spacious to permit one or more persons to work efficiently. Usually the basic food preparation is carried on in a kitchen area away from the food bar and the final preparation takes place in the food preparation area 1. The personnel working inside the bar can make up special dishes for persons sitting at the counter, keep the food carriers supplied, converse with patrons, and in general oversee the operation of the food display and serving system.

The watercourse 2 need not be of any particular shape in cross section and here consists of a simple open top U-shape having a bottom 9 and sides 10 and 11. The plan configuration of the watercourse may vary and here consists of an oval having two straight sections 12 and 13 and two end curved sections 14 and 15.

The counter 3 has a width sufficient to hold the trays 6, tea, napkins and eating utensils. The counter height may be at either a level at which patrons may stand or be seated at chairs 16. Preferably the counter 3 and the bottom 9 of the watercourse are at the same elevation.

The key element in the display and serving system is the floating carrier 4. The carrier could be a tray, disc, raft or take any shape consistent with the theme of the restaurant. The carriers illustrated in the drawing are small wooden boats, crafted from an ancient Japanese design having a high bow 17, a low square stern 18 and a flat deck 19. The deck can hold 3 or more trays of food without crowding so that it is easy for patrons to select and remove a single tray.

The connecting means 7 joining the carriers could be a single flexible member with each boat joined at least at its bow or forward portion to a single flexible member. Applicant has found, however, that it is preferable to join each boat with a short length of a light weight chain 7. The bow and stern of each boat is fitted with hooks 20 and 21 to which the short chains are attached.

Movement of the boats is caused by a means for creating a current in the watercourse. Several methods for creating the current may be used. Examples of such systems may be seen in the Fishing Game Device by Popovich, U.S. Pat. No. 4,165,075 (1979) having a pump and water jet; Game Apparatus by Wood, U.S. Pat. No. 1,389,611 (1921) a pump; Swimming Course by Lippincott, U.S. Pat. No. 1,331,270 (1920) paddle wheel; or Fishing Game by Gelbant, U.S. Pat. No. 3,106,394 (1963) jet.

Applicant has found that a pump 22 driven by an electric motor 23 and forcing water at an elevated pressure through manifold pipe 24 through a plurality of water jets 25 produces a current sufficient to propel the boats.

Figure 7:
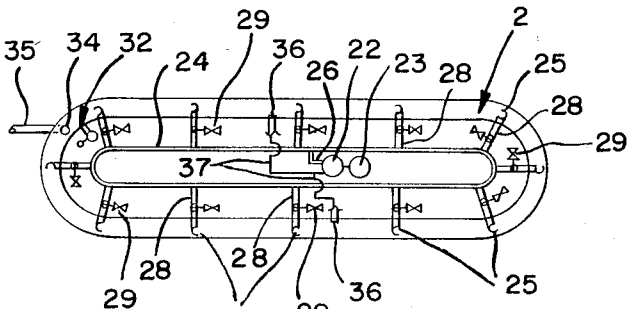
FIG. 7 is a schematic of the water system for introducing and draining water from the system and for creating the water current.

A schematic of the system for producing the current is illustrated in FIG. 7. A pump discharge conduit 26 is connected to the discharge side of the pump and feeds the water under pressure to a manifold pipe 24. A plurality of discharge pipes 28 are connected to the manifold pipe and feed a plurality of discharge jets 25 located in the watercourse. Preferably each discharge pipe is fitted with a valve 29 for regulating the discharge from the jets. The flow of the jets should be relatively uniform but it is advantageous to be able to increase the flow at bends in the watercourse or where the spacing between the jets is uneven. Further, all of the valves may be regulated to regulate the speed at which the boats travel.

Figure 5:
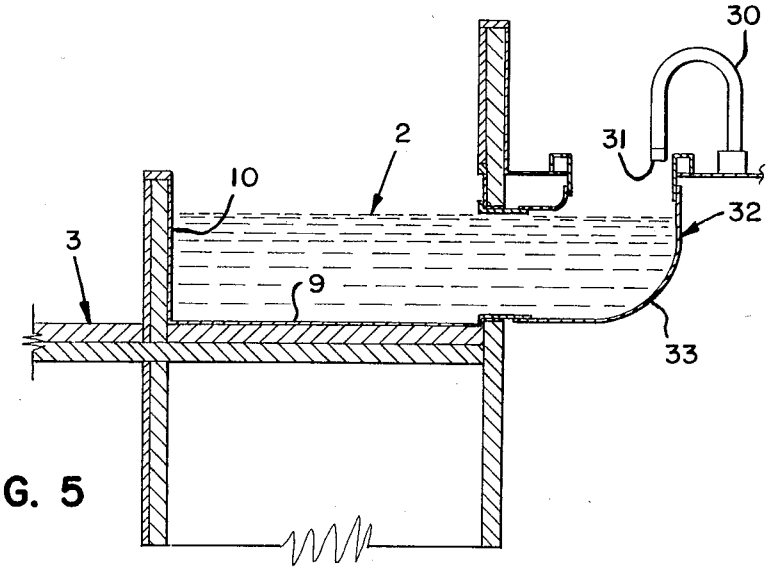
FIG. 5 is an enlarged cross sectional view of a portion of the bar taken generally along line 5—5 of FIG. 1.

The water should be changed at regular intervals to insure its freshness. FIG. 5 illustrates one form of introducing new water to the system by means of an inflow pipe 30 having its discharge near the water surface. Preferably, the discharge 31 is into an inlet area 32 which may consist of a 4" diameter pipe elbow 33 which is connected to the side of the watercourse and extends laterally outwardly to the discharge opening 31 of the inlet pipe 30. Locating the inlet outside the watercourse enables the level of water in the watercourse to be raised without drenching the decks of the boats or disturbing the current in the trough. Introduction of water is necessary for example during the following circumstance. Before and during peak meal times, all of the boats will be heavily laden with food. The boats displace more water when loaded and raise the level of water in the trough. To prevent overflow, water may be released from the watercourse by drain opening 34 in the bottom 9 of the watercourse which is connected to drain pipe 35. After the boats have been unloaded, they will displace less water and new water may be added through inlet pipe 30.

Figure 4:
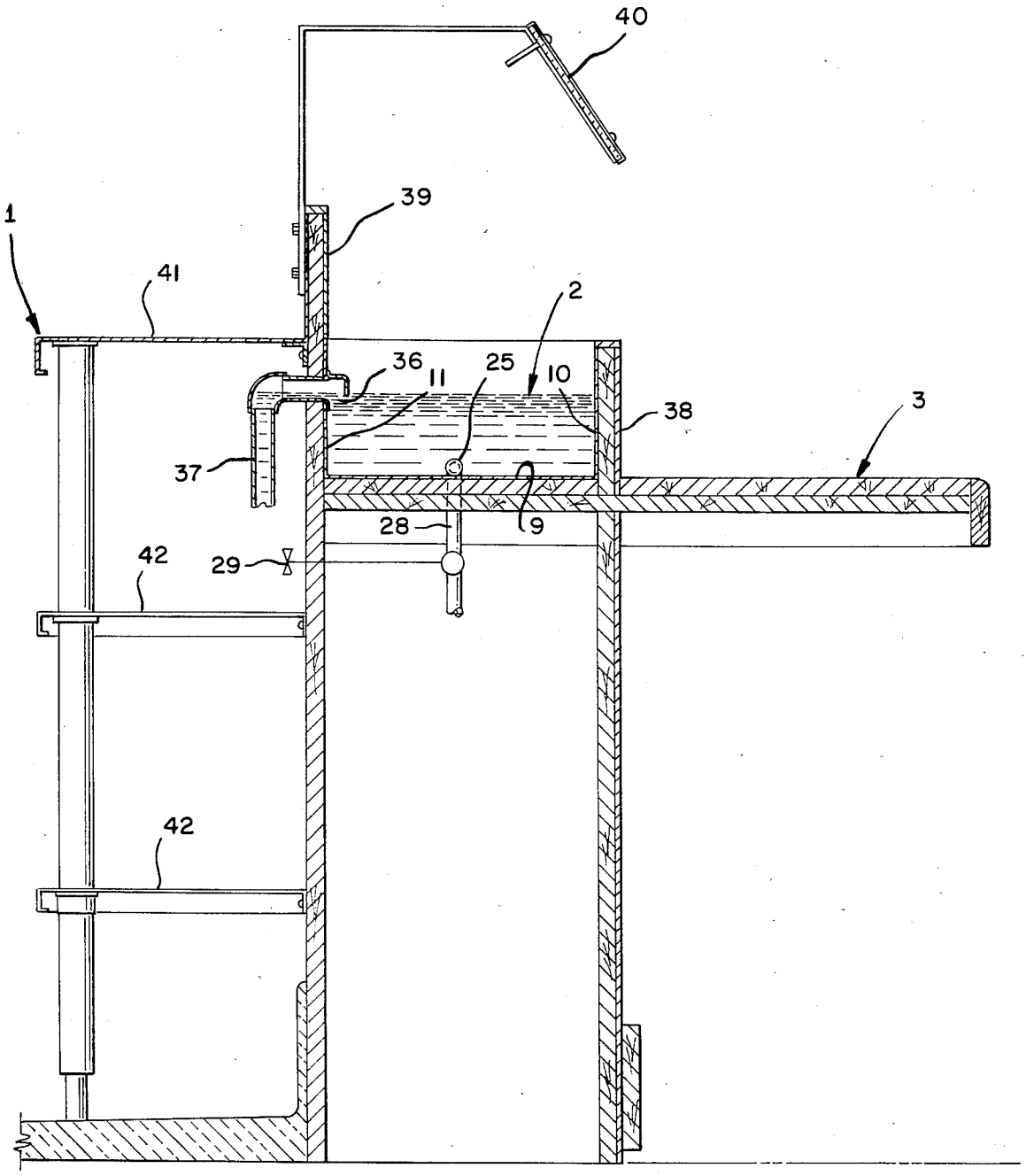
FIG. 4 is an enlarged cross sectional view of a portion of the bar taken generally along line 4—4 of FIG. 1.
Figure 6:
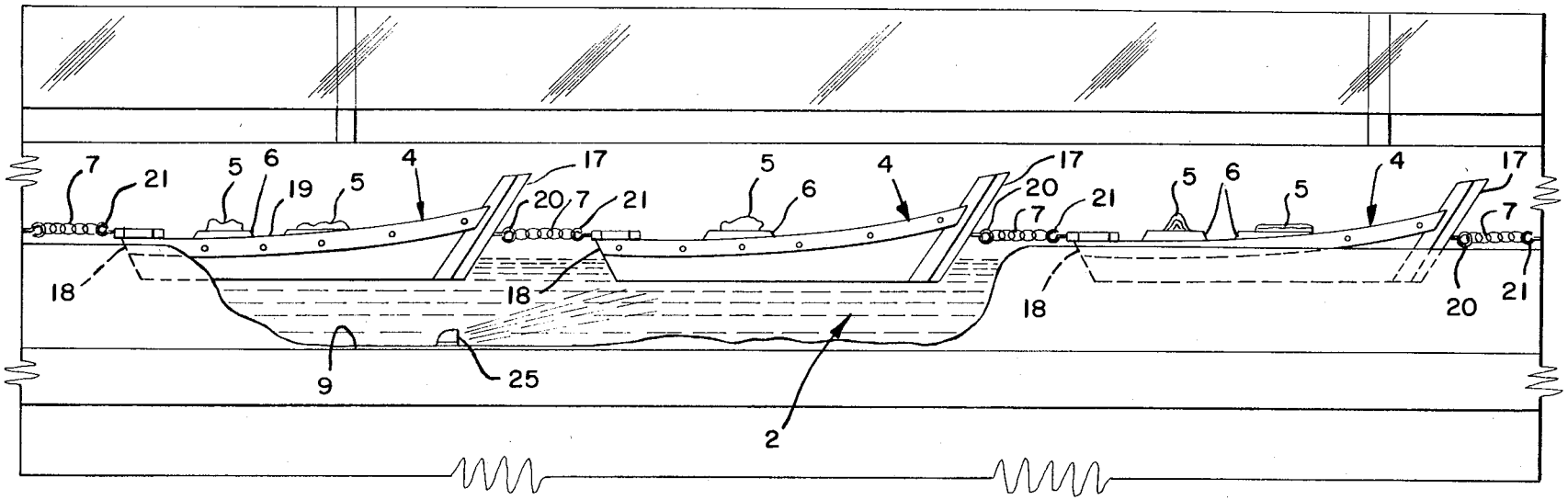
FIG. 6 is a partial side view of the bar showing the boats and a portion of the watercourse by the removal of portions of a side of the watercourse wall.

As shown in FIG. 4, the inlet opening 36 of the overflow pipe 37 is located below the lowest operating level of the water in the watercourse. Water returns to the pump 22 where it is pumped back to the manifold pipe 24.

A key element in the trouble free operation of the boats is the fact that all of the boats are connected in an endless succession. This prevents the boats from passing one another and resulting in jamming at the turns. The boats are connected by short flexible members. A small light chain is preferable both for functional and aesthetic considerations. A chain can be lengthened or shortened easily to adjust the proper distance between the boats and permit a single boat to be easily removed and replaced for cleaning or servicing.

The length of the flexible member is critical. The boats should not be permitted to touch during operation to prevent collisions which can damage the surface of the boats. The length of the flexible member should be selected so that each boat is guided and may be towed by the boat ahead of it but never pushes the boat ahead. By permitting only a small amount of slack in the chain, the boat has only a minimum of free travel longitudinally. In addition to preventing bumping of the boats into one another, movement both longitudinally and laterally caused by the disturbance caused by off loading the boats is restricted. It is important to provide boat stability with the flexible connection system so that anyone can off load the boats without spilling the trays remaining on the boat.

As previously mentioned, the boats have relatively flat bottoms for stability. In addition, flat bottom boats present a large and non-variable amount of surface area to interact with the water current to propel the boats around the watercourse. It has been found that it is unnecessary to provide any type of protrusion from the bottom of the boat to catch the water current.

Preferably, the carrier or boat is formed with a relatively square stern presenting a relatively flat surface to the direction of the water current. With the boat having a tapered bow, there is a slightly greater force on the stern of the boat. The boat is guided by the attachment of the bow to the preceding boat and by the gentle bumping of the boats against the side of the watercourse.

Figure 2:
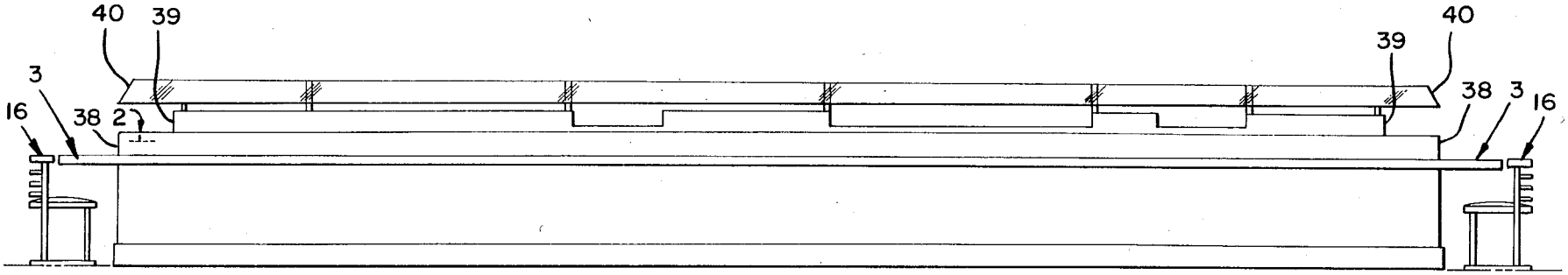
FIG. 2 is a side view of the displaying and serving bar illustrated in FIG. 1.
Figure 3:
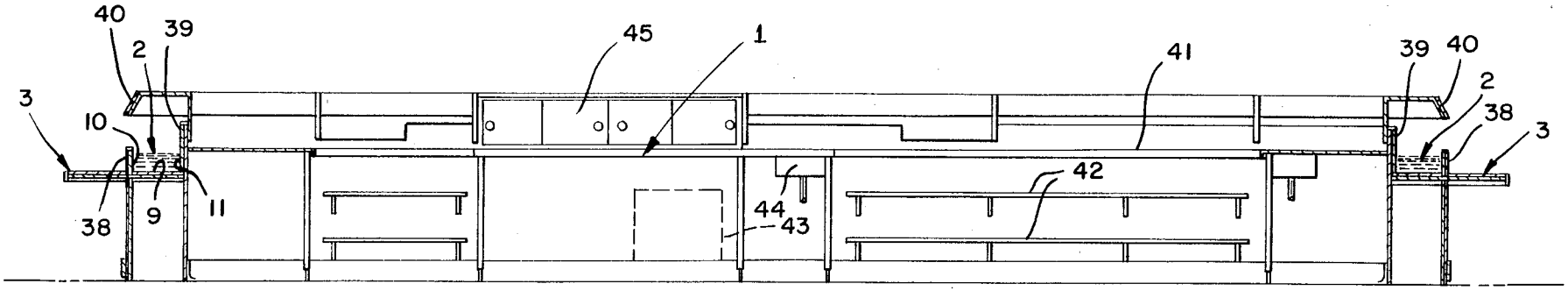
FIG. 3 is a cross sectional view of the bar taken along 3—3 of FIG. 1.

Referring to FIGS. 2, 3 and 4, the side 10 of the watercourse is covered by a side board 38 which serves as a support for the watercourse side 10 and as a backboard for the counter 3. An inner railing 39 serves both as a visual shield to the inner food preparation area 1 and as a support for a transparent guard 40 to shield the top of the watercourse.

The food preparation area is outfitted with the usual counters 41, shelves 42, refrigeration unit 43, sinks 44 and display case 45.

The speed of the boats may vary but in the San Francisco installation, the boats make a round trip about once every two minutes.

The operation of the food display and serving system is as follows.

Some basic preparation of the food is initiated in a kitchen area and then brought to the food preparation area of the bar. A variety of foods are prepared and placed on trays 6. The trays may have one or more different designs or shapes so that food having the same price is placed on like trays. For example, one type of food may have a price of $1.00 and be placed on trays having one design. Foods having a price of $2.00 are placed on trays having a second design. The trays are either placed in the display area and held temporarily or placed directly on the boats. The boats travel along the watercourse propelled by the water jets past the patrons seated along the counter 3.

When the patron makes a selection either from the menu or merely observing the foods as they travel past, he waits until the boat is in front of him and merely lifts the tray from the boat. Waitresses serve tea from behind the patron, and assist in the selection of the food if necessary. When the patron is finished eating, the waitress simply counts the number and type of empty trays and prepares a bill. The waitress removes the empty trays from the counter and carries them to a washing facility away from the counter.

I claim:

1. A restaurant food display and serving system comprising a food preparation area, a watercourse surrounding said food preparation area, a counter for the receipt of food dishes surrounding said watercourse, a plurality of individual floating carriers for transporting food in recepticles, connecting means joining said floating carriers in an endless succession spaced from one another a selected distance so that said carriers cannot touch an adjacent carrier, and means for creating a water current in said watercourse for propelling said carriers around said watercourse, said connecting means including a plurality of flexible discrete members each joining the bow and stern of adjacent carriers, each discrete flexible member having a selected length so that the carriers do not touch during normal operation of the system, each of said discrete flexible members having a selected length so that each individual carrier can move a selected distance laterally with respect to said carrier in front and behind, and each of said discrete flexible members having a selected length so that a selected carrier may be stopped and the carrier behind will draw closer but will not touch said selected carrier.

2. A system as described in claim 1 wherein:

a. said carriers are boats having a relatively flat bottom for stability and provide a relatively large contact area with the moving current created by said water current means;

b. said carriers have a tapered bow for directional stability and negotiating the turns in said watercourse; and c. said carrier have a relatively flat stern for coaction with the current created by said water current.

3. A system as described in claim 1:

a. said means for creating a current includes a water pump and motor set, a manifold connected to said pump and mounted adjacent a substantial portion of said watercourse, a plurality of discharge pipes connected to said manifold at spaced intervals, and a plurality of discharge jets connected at spaced intervals along said watercourse.

4. A system as described in claim 3 comprising:

a plurality of valves connected to said discharge pipes for selectively regulating the discharge from said jets.

5. A restaurant food display and serving system comprising a closed watercourse, a counter, a plurality of individual floating carriers for transporting objects, each of said carriers having a front-end section and a back-end section, a means for creating a water current in said watercourse for propelling said carriers around said watercourse, and connecting means which join said carriers in an endless succession generally spaced from one another by a selected distance, said connecting means including a plurality of flexible discrete members each joining the front and back end sections of adjoining carriers, each discrete flexible member having a selected length so that said carriers do not touch one another during normal operation of said system, that each of said carriers can move a selected distance laterally with respect to said carrier in front and behind, and that a selected one of said carriers may manually be stopped temporarily during normal operation of said system without causing bunching of said carriers and permit the manual removal of said objects from said selected one of said carriers.

6. The system of claim 5 wherein said connecting means are further adapted to prevent said carriers from bunching together along said watercourse.

7. The system of claim 5 wherein said connecting means are individual, flexible members.

8. The system of claim 7 wherein each of said flexible members has a selected length so that said carriers can individually move up to a predetermined maximum lateral distance transversely with respect to said water current.

9. The system of claim 7 wherein each of said flexible members connects two of said carriers so that said carriers form a single loop.

10. The system of claim 5 wherein said closed watercourse surround a central area adapted to be used as a food preparation area.

11. The system of claim 5 wherein said carriers are boats having a relatively flat bottom for stability and provide a relatively large contact area with the moving current created by said water current means, said carriers have a tapered bow for directional stability and negotiating the currents in said watercourse, and said carrier has a relatively flat stern for coaction with the current created by said water current means.

12. The system of claim 5 wherein said means for creating a current includes a water pump and motor set, a manifold connected to said pump and mounted adjacent a substantial portion of said watercourse, a plurality of discharge pipes connected to said manifold at spaced intervals, and a plurality of discharge jets connected at spaced intervals along said watercourse.

13. The system of claim 12 further comprising a plurality of valves connected to said discharge pipes for selectively regulating the discharge from said jets.

* * * * *